United States Patent [19]

Haga et al.

[11] Patent Number: 4,994,351

[45] Date of Patent: Feb. 19, 1991

[54] SILVER HALIDE COLOR PHOTOGRAPHIC MATERIAL

[75] Inventors: Yoshihiro Haga; Katuya Yabuuchi; Yasumasa Numata, all of Tokyo, Japan

[73] Assignee: Konica Corporation, Tokyo, Japan

[21] Appl. No.: 366,217

[22] Filed: Jun. 15, 1989

Related U.S. Application Data

[63] Continuation of Ser. No. 128,999, Dec. 4, 1987, abandoned.

[30] Foreign Application Priority Data

Dec. 17, 1986 [JP] Japan ..... 61-303554

[51] Int. Cl.[5] ..... G03C 5/50; G03C 7/38; G03C 7/392

[52] U.S. Cl. ..... 430/379; 430/386; 430/409; 430/551; 430/558

[58] Field of Search ..... 430/379, 386, 558, 551

[56] References Cited

U.S. PATENT DOCUMENTS

| | | | |
|---|---|---|---|
| 4,584,264 | 4/1986 | Ohki et al. | 430/542 |
| 4,717,651 | 1/1988 | Ohki et al. | 430/551 |
| 4,738,919 | 4/1988 | Krauss et al. | 430/551 |
| 4,797,351 | 1/1989 | Ishikawa et al. | 430/387 |

*Primary Examiner*—Paul R. Michl
*Assistant Examiner*—Mark R. Buscher
*Attorney, Agent, or Firm*—Jordan B. Bierman

[57] ABSTRACT

A silver halide color photographic material is described which is to be processed by a scheme including at least the step of development with a color developer having a pH of at least 11 wherein said material contains a specific pyrazoloazole based magenta coupler and a compound that react with the oxidized product of a color developing agent and which substantially lacks the ability to impart an image density. The color photographic material is improved in granularity and color reproduction and yet permits efficient desilvering.

11 Claims, No Drawings

SILVER HALIDE COLOR PHOTOGRAPHIC MATERIAL

This application is a continuation of application Ser. No. 128,999 filed Dec. 4, 1987, now abandoned.

BACKGROUND OF THE INVENTION

The present invention relates to a silver halide color photographic material. More particularly, the present invention relates to a silver halide color photographic material that is improved in granularity and color reproduction and which yet permits efficient desilvering.

The need for a silver halide color photographic material (hereinafter referred to as "a color photographic material") capable of producing high-quality image is constantly growing and a particularly strong need exists for improving its granularity and color reproduction.

Dyes formed as a result of coupling reaction between couplers and the oxidized products of aromatic primary amino developing agents have unwanted absorption in varying degrees and cause undesired phenomena in color reproduction such as hue distortion and reduced color purity. In particular, dyes formed from 5-pyrazolone based magenta couplers have pronounced absorption in the blue at about 430 nm and active efforts have been made to develop magenta couplers having a minimum degree of such secondary absorption. Magenta couplers that have been developed to meet this need include the pyrazolotriazole compounds described in U.S. Pat. No. 3,725,067 and the pyrazolopyrazole compounds described in Research Disclosure No. 24230, June 1984. However, these magenta couplers have such a nature that their ability to form color is increased with the pH of color developers. In the color reversal process, the pH of the color developer used is high (typically in the range of 11–13) as compared with the case of processing of color negative films or color photographic paper, and the above-mentioned magenta couplers cannot be commercially used in such color reversal process without reducing sensitivity or increasing granularity on account of their high color forming ability.

A scavenger of the oxidized product of a color developing agent is frequency incorporated in light-sensitive emulsion layers containing the above-mentioned couplers with a view to preventing the increase in granularity but this often causes a decrease in the efficiency of desilvering.

It is therefore desired to develop a photographic technique that is free from the problem of reduced sensitivity and which improves granularity and color reproduction without adversely affecting the efficiency of desilvering.

SUMMARY OF THE INVENTION

An object, therefore, of the present invention is to provide a color photographic material that is improved in granularity and color reproduction and which yet permits efficient desilvering.

As a result of intensive studies conducted in order to attain this object, the present inventors discovered the combination of the techniques described below and have eventually accomplished the present invention on the basis of this discovery. The present invention relates to a color photographic material that has photographic constituent layers including one or more light-sensitive silver halide emulsion layers and one or more non-light-sensitive layers and which is to be processed by a scheme including at least the step of development with a color developer having a pH of at least 11. This color photographic material is characterized in that at least one of said light-sensitive silver halide emulsion layers contains a coupler represented by the general formula (M-I) noted below and that at least one of said photographic constituent layers contains a compound that reacts with the oxidized product of a color developing agent and which substantially lacks the ability to impart an image density:

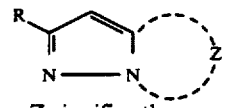

(M-I)

where Z signifies the group of non-metallic atoms necessary for forming a nitrogenous heterocyclic ring, provided that the ring formed by Z may have a substituent; R is a hydrogen atom or a substituent.

DETAILED DESCRIPTION OF THE INVENTION

The present invention is hereinafter described in greater detail.

The coupler that is to be specifically incorporated in the color photographic material of the present invention is represented by the following general formula (M-I):

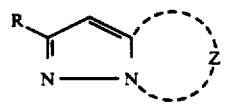

(M-I)

where Z signifies the group of non-metallic atoms necessary for forming a nitrogenous heterocyclic ring, provided that the ring formed by Z may have a substituent; R is a hydrogen atom or a substituent.

The substituents denoted by R are not limited to any particular type but typical examples include alkyl, aryl, anilino, acylamino, sulfonamido, alkylthio, arylthio, alkenyl and cycloalkyl groups. Other examples include: halogen atoms; a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclic oxy group, a siloxy group, an acyloxy group, a carbamoyloxy group, an amino group, an alkylamino group, an imido group, a ureido group, a sulfamoylamino group, an alkoxycarbonyl amino group, an aryloxycarbonylamino group, an alkoxycarbonyl group, an aryloxycarbonyl group, and a heterocyclic thio group; and a spiro compound residue and a bridged hydrocarbon compound residue.

The alkyl group represented by R preferably has 1–32 carbon atoms and it may be straight-chained or branched.

The aryl group represented by R is preferably a phenyl group.

The acylamino group represented by R is exemplified by an alkylcarbonylamino group and an aryl carbonylamino group.

The sulfonamido group represented by R is exemplified by an alkylsulfonylamo group and an arylsulfonylamino group.

The alkyl moiety in the alkylthio group represented by R and the aryl moiety in the arylthio group also represented by R may be the alkyl and aryl groups, respectively, signified by R.

The alkenyl group represented by R preferably has 2–32 carbon atoms; the cycloalkyl group represented by R preferably has 3–12 carbon atoms, more preferably 5–7 carbon atoms; the alkenyl group represented by R may be straight-chained or branched.

The cycloalkenyl group represented by R preferably has 3–12 carbon atoms, more preferably 5–7 carbon atoms.

The sulfonyl group represented by R is exemplified by an alkylsulfonyl group and an arylsulfonyl group; the sulfinyl group represented by R is exemplified by an alkylsulfinyl group and an arylsulfinyl group; the phosphonyl group represented by R is exemplified by an alkylphosphonyl group, an alkoxyphosphonyl group, an aryloxyphosphonyl group, and an arylphosphonyl group; the acyl group represented by R is exemplified by an alkylcarbonyl group and an arylcarbonyl group; the carbamoyl group represented by R is exemplified by an alkylcarbamoyl group and an arylcarbamoyl group; the sulfamoyl group represented by R is exemplified by an alkylsulfamoyl group and an arylsulfamoyl group; the acyloxy group represented by R is exemplified by an alkylcarbonyloxy group and an arylcarbonyloxy group; the carbamoyloxy group represented by R is exemplified by an alkylcarbamoyloxy group and an arylcarbamoyloxy group; the ureido group represented by R is exemplified by an alkylureido group and an arylureido group; the sulfamoylamino group represented by R is exemplified by an alkylsulfamoylamino group and an arylsulfamoylamino group; the heterocyclic group represented by R is preferably 5- to 7-membered and is illustrated by a 2-furyl group, a 2-thienyl group, a 2-pyrimidinyl group, and a 2-benzothiazolyl group; the heterocyclic oxy group represented by R preferably has a 5- to 7-membered heterocyclic ring and may be illustrated by a 3,4,5,6-tetrahydropyranyl-2-oxy group and a 1-phenyltetrazol-5-oxy group; the heterocyclic thio group represented by R is preferably 5- to 7-membered and may be illustrated by a 2-pyridylthio group, a 2-benzothiazolylthio group, a 2,4-diphenoxy-1,3,5-triazole-6-thio group; the siloxy group represented by R is exemplified by a trimethylsiloxy group, a triethylsiloxy group and a dimethylbutlysiloxy group; the imido group represented by R is exemplified by a succinimodo group, a 3-heptadecylsuccinimido group, a phthalimido group and a glutarimido group; the spiro compound residue represented by R is exemplified by a spiro(3,3-)heptan-1-yl; and the bridged hydrocarbon compound residue represented by R is illustrated by a bicyclo(2,2,1)heptan-1-yl, tricyclo(3,3,1,1$^{3,7}$)decan-1-yl, and 7,7-dimethyl-bicyclo(2,2,1)heptan-1-yl.

Examples of the nitrogenous heterocyclic ring formed by Z include a pyrazole ring, an imidazole ring, a triazole ring, and a tetrazole ring. These rings may have substituents selected from among the substituents listed above for R.

The compounds of formula (M-I) may be represented more specifically by the following general formulas (M-II) to (M-VII):

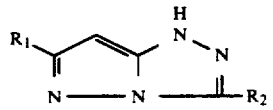
(M-II)

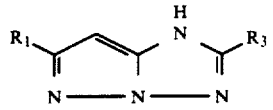
(M-III)

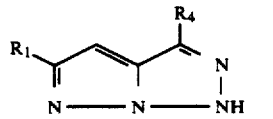
(M-IV)

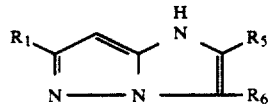
(M-V)

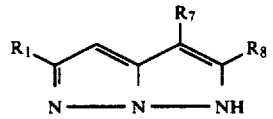
(M-VI)

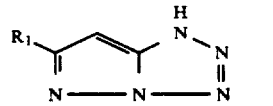
(M-VII)

where $R_1$–$R_8$ have the same meanings as defined for R in formula (M-I).

A preferred example of the compound (M-I) is represented by the following general formula (M-VIII):

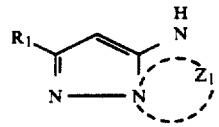
(M-VIII)

where $R_1$ and $Z_1$ have the same meanings as defined for R and Z in formula (M-I).

Among the magenta couplers represented by formulas (M-II) to (M-VII), the one represented by formula (M-II) is particularly preferred.

In the most preferred case, substituents R and $R_1$ on the heterocyclic ring in each of the formulas (M-1) to (M-VIII) are represented by the following general formula (M-IX):

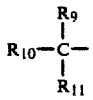
(M-IX)

where $R_9$, $R_{10}$ and $R_{11}$ each has the same meaning as defined for R.

Any two of $R_9$, $R_{10}$ and $R_{11}$, for example, $R_9$ and $R_{10}$, may combine together to form a saturated or unsaturated ring (e.g., cycloalkane, cycloalkene or hetero ring), which may be further combined with $R_{11}$ to form a bridged hydrocarbon compound residue.

Two preferred cases of the formula (M-IX) are described below: (i) at least two of $R_9$–$R_{11}$ are alkyl groups; and (ii) one of $R_9$–$R_{11}$, for example, $R_{11}$, is a hydrogen atom and the other groups ($R_9$ and $R_{10}$) combine to form a cycloalkyl together with the common carbon atom. In the case of (i), it is preferred that two of $R_9$–$R_{11}$ are alkyl groups and the remainder is a hydrogen atom or an alkyl group.

The ring formed by Z in formula (M-I) and the ring formed by $Z_1$ in formula (M-VIII) may each have a substituent. This substituent, as well as $R_2$–$R_8$ in formulas (M-II) to (M-VI) are preferably represented by the following general formula (M-X):

$$-R_{12}-SO_2-R_{13} \qquad \text{(M-X)}$$

where $R_{12}$ is an alkylene group; $R_{13}$ is an alkyl group, a cycloalkyl group or an aryl group.

The alkylene group represented by $R_{12}$ preferably has at least 2, more preferably 3–6, carbon atoms in the straight-chained portion, but this alkylene group may be straight-chained or branched.

The cycloalkyl group represented by $R_{13}$ is preferably 5- or 6-membered.

Typical examples of the compound that characterizes the present invention are listed below.

1

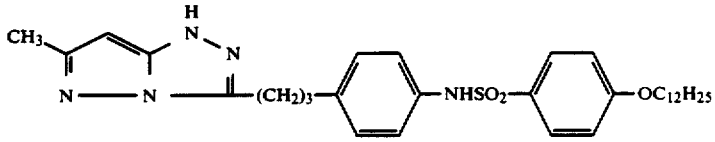

2

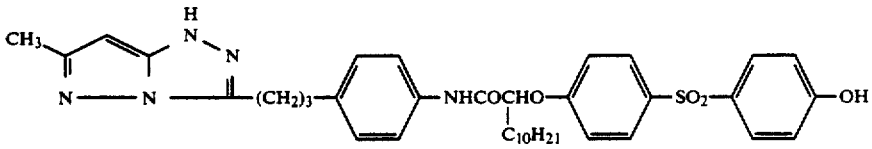

3

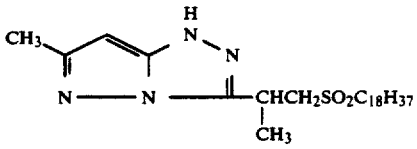

4

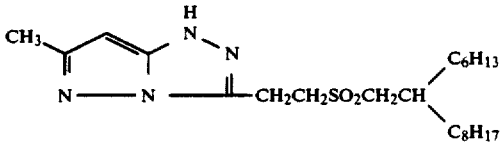

5

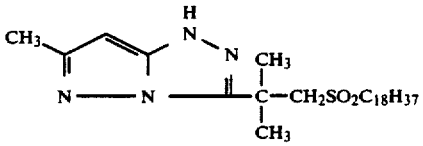

6

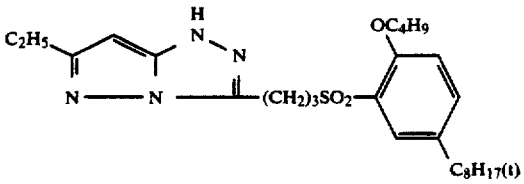

7

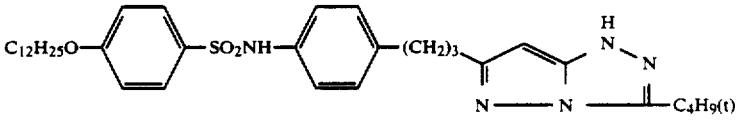

8

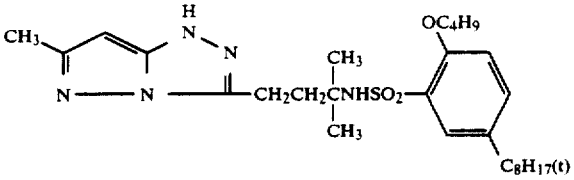

-continued
9
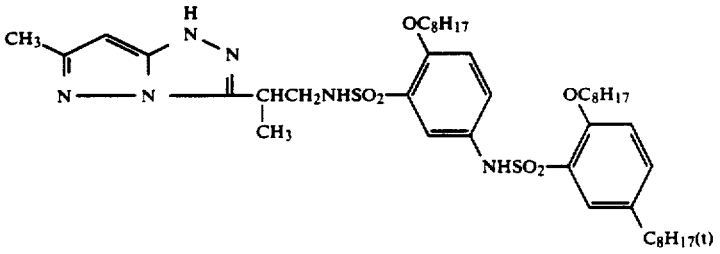
10
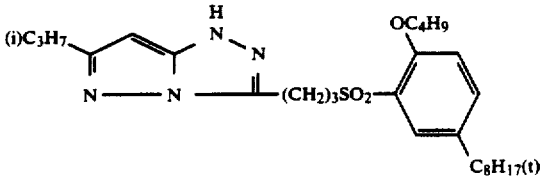
11
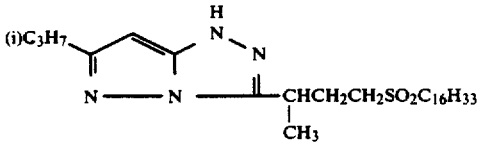
12
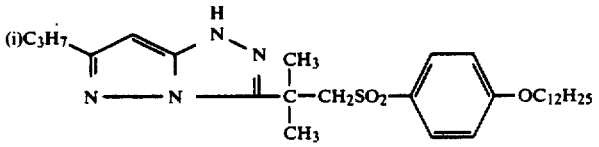
13
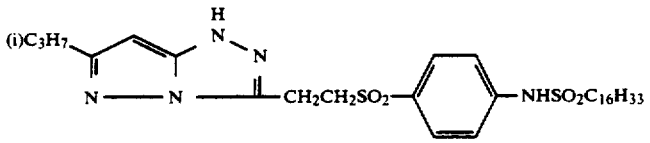
14
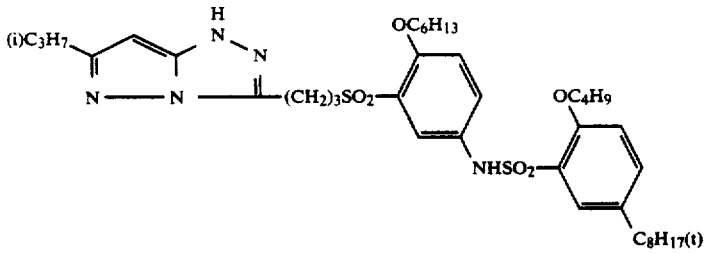
15
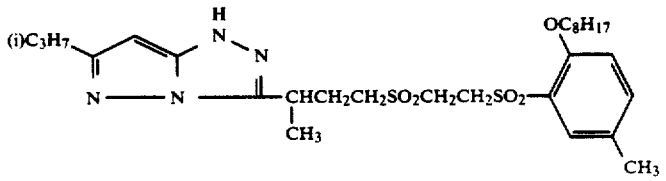
16
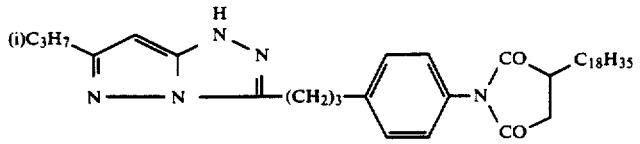

-continued
17
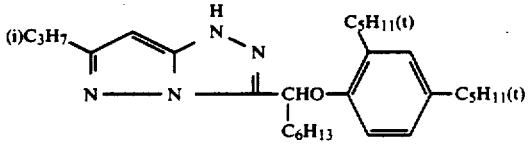
18
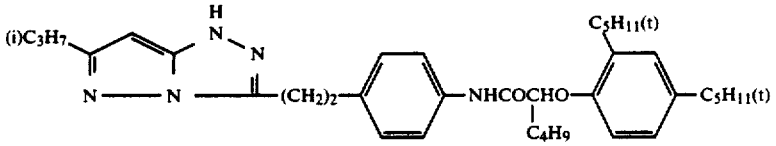
19
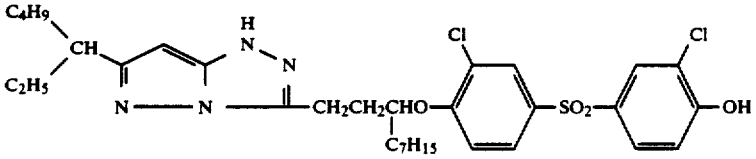
20
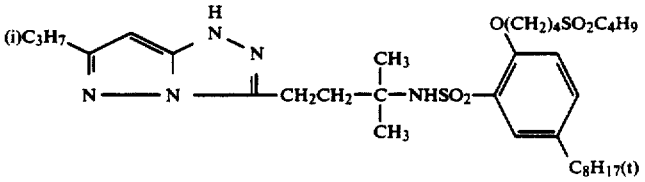
21
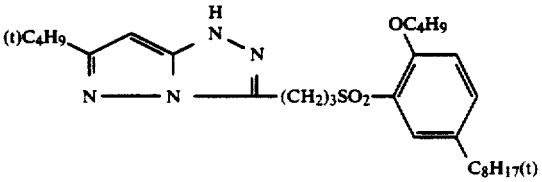
22
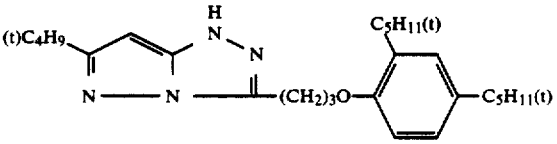
23
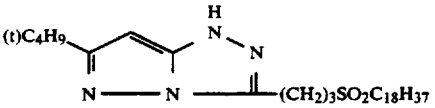
24
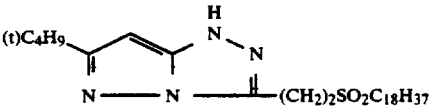
25
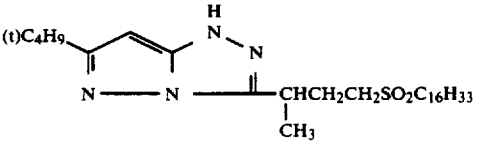
26
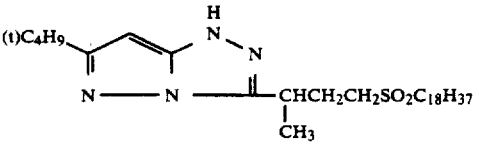

-continued
27
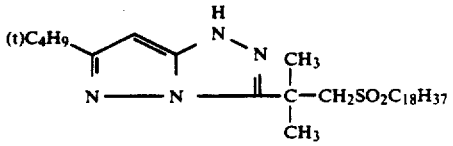
28
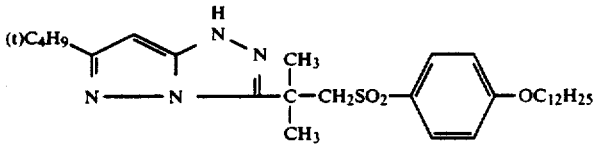
29
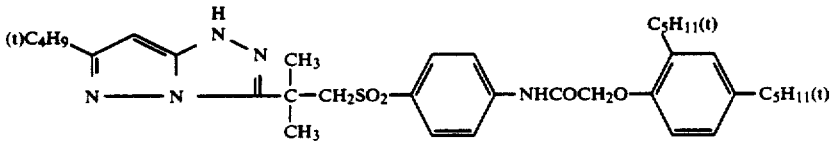
30
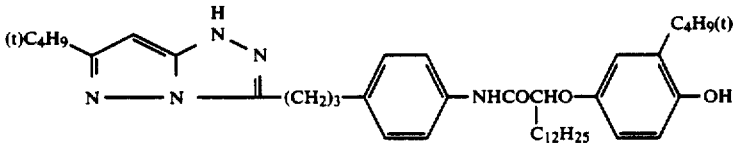
31
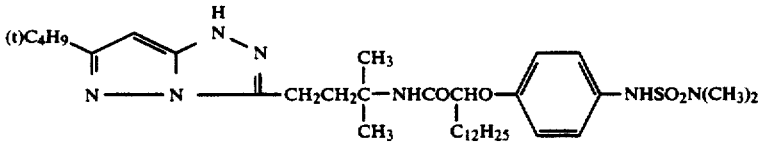
32
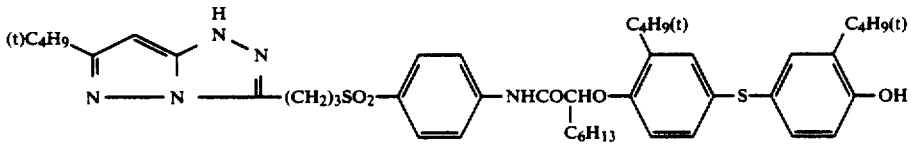
33
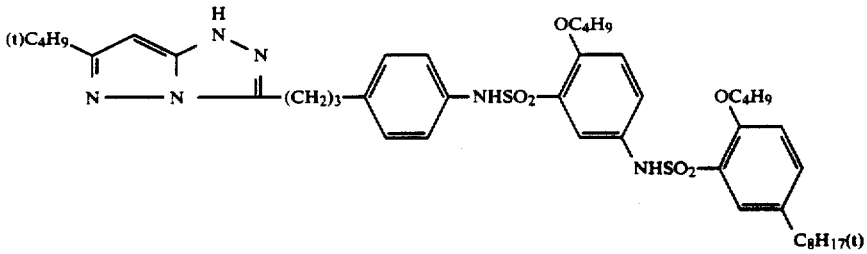
34
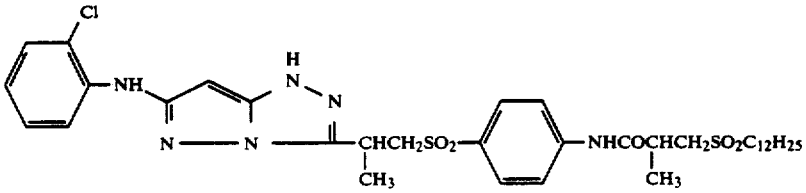
35
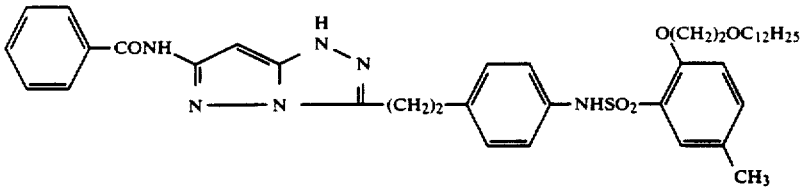

-continued
36
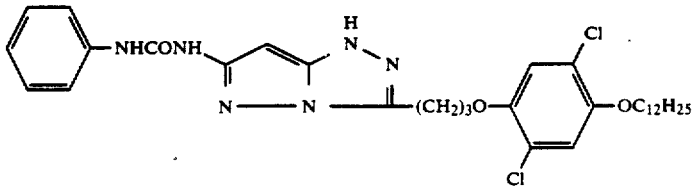
37
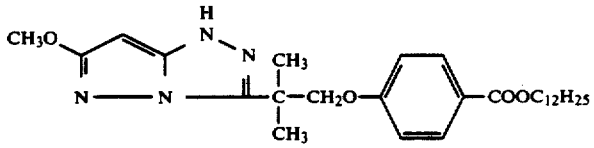
38
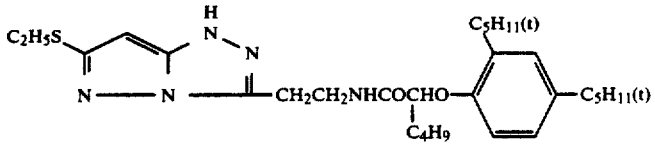
39
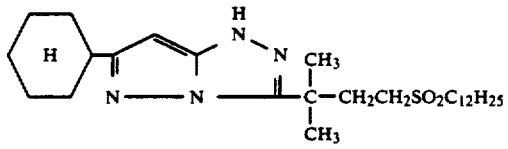
40
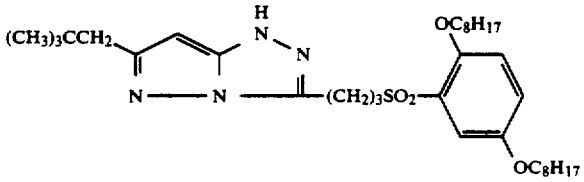
41
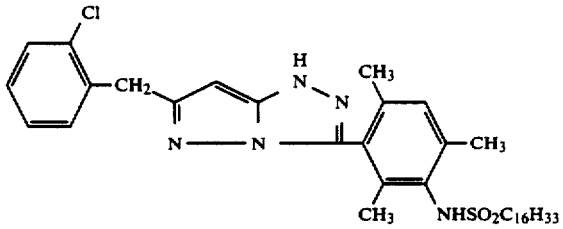
42
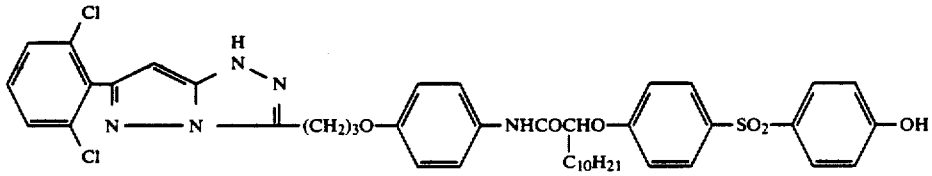
43
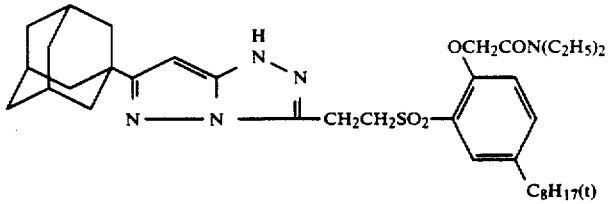

-continued
44
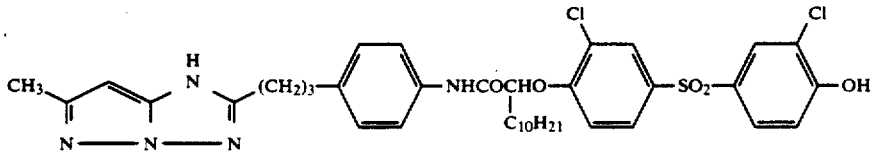
45
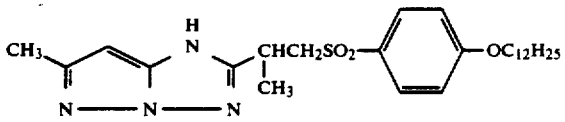
46
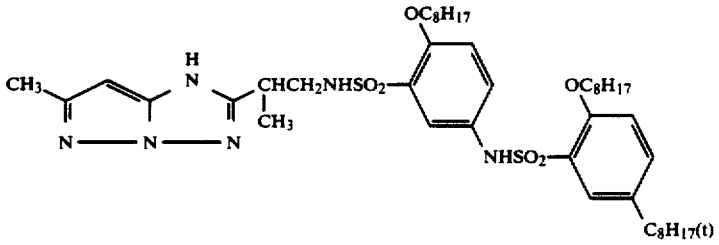
47
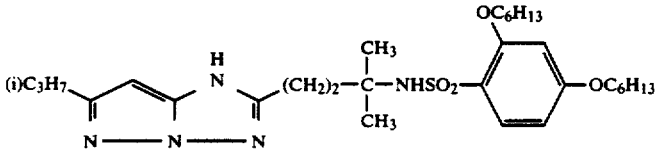
48
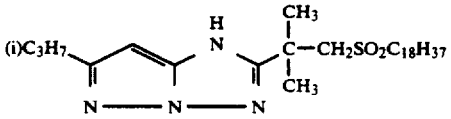
49
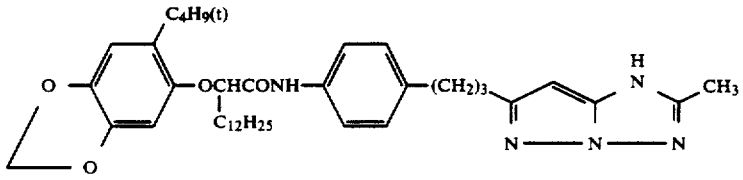
50
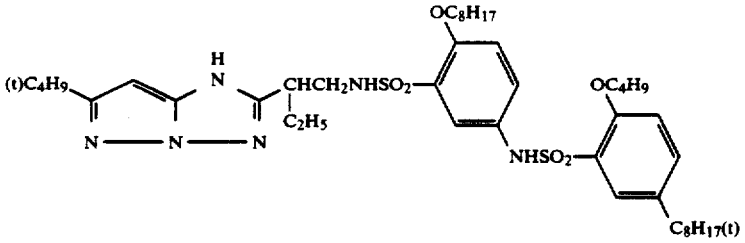
51
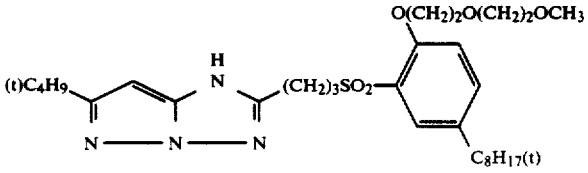
52
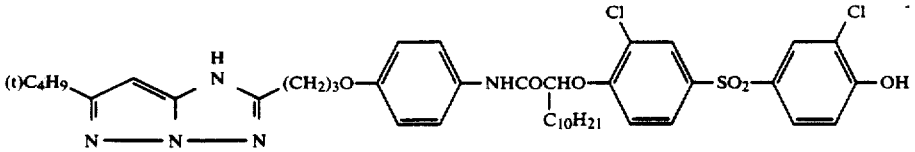

-continued

53

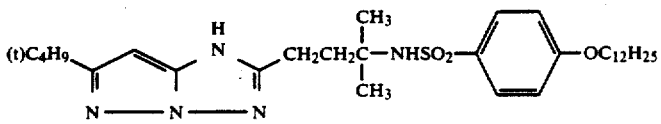

54

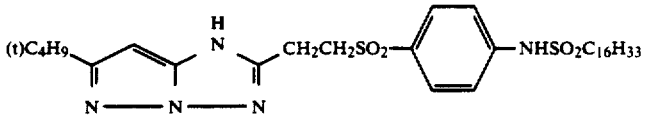

55

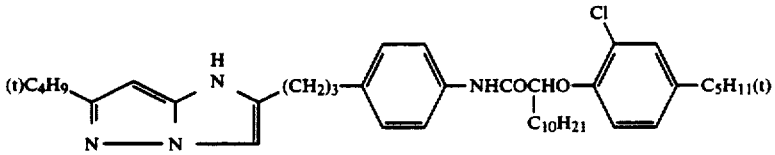

56

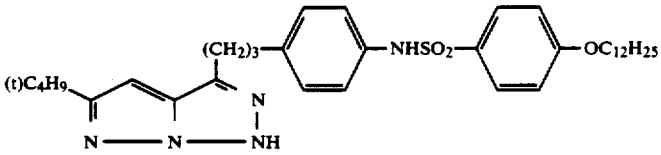

57

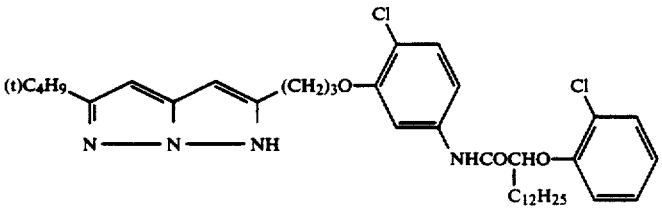

58

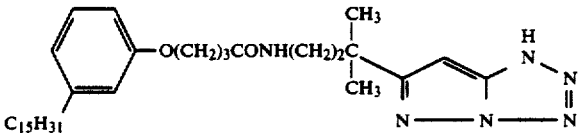

59

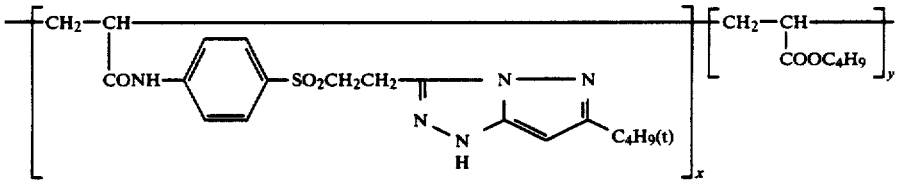

x:y = 50:50

59

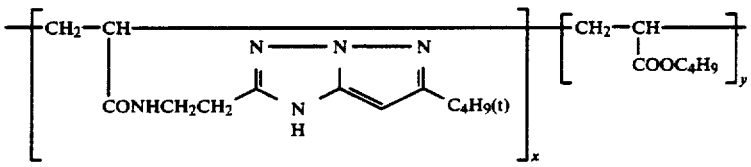

x:y = 50:50

The above-listed couplers to be used in the present invention may be synthesized by making reference to Journal of the Chemical Society, Perkin I (1977), pp. 2047–2052, and patents such U.S. Pat. No. 3,725,067, and Unexamined Published Japanese Patent Application Nos. 99437/1984, 42045/1983, 162548/1984, 171956/1984, 33552/1985, 43659/1985, 172982/1985, and 190779/1985.

The couplers to be used in the present invention may be used in amounts that typically range from $1\times10^{-3}$ to 1 mole, preferably from $1\times10^{-2}$ to $8\times10^{-1}$ moles, per mole of silver halide.

The couplers may be used in combination with other types of magenta couplers.

The couplers may be incorporated in emulsions by any known method. For instance, these couplers, taken either individually or in admixture, are dissolved in high-boiling point (≧175° C.) organic solvents such as tricresyl phosphate and dibutyl phthalate or low-boiling solvents such as butyl acetate and butyl propionate (the two types of solvents may be mixed together, if desired), and the resulting solution is mixed with an aqueous gelatin solution containing a suitable surfactant, followed by emulsification with a high-speed rotary mixer or a colloid mill. The resulting product is added to a silver halide so as to prepare a silver halide emulsion suitable for use in the present invention.

The color photographic material of the present invention is also characterized by using a compound that reacts with the oxidized product of a color developing agent and which substantially lacks the ability to impart an image density. This compound is categorized as a scavenger of the oxidized product of a color developing agent and is hereinafter referred to as a DP' scavenger. Preferred examples of this DP' scavenger include: a hydroquinone based compound represented by the following general formula (H); a pyrogallol-, catechol- or resorcin-based compound represented by the following general formula (P); a sulfonylamino based compound represented by the following general formula (S); and a coupling-type compound represented by the following general formula (C):

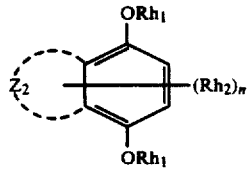

(H)

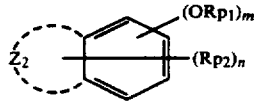

(P)

where $Rh_1$ and $Rp_1$, which may be the same or different, each represents a hydrogen atom, an aliphatic group or an acyl group; m is 2 or 3 and if m=2, the two $ORp_1$ are on the ortho or meta position, and if m=3, the three $ORp_1$ are bonded to mutually adjacent sites; $Rh_2$ and $Rp_2$, which may be the same or different, each represents a monovalent group; n is an integer of 0–6; —Z— denotes that a naphthalene ring may be formed together with the benzene ring.

The aliphatic group represented by $Rh_1$ and $Rp_1$ may have a substituent and may be exemplified by alkyl, alkenyl, etc.

The acyl group represented by $Rh_1$ and $Rp_1$ may be exemplified by an alkylcarbonyl, an arylcarbonyl group, etc.

The monovalent group represented by $Rh_2$ and $Rp_2$ may be illustrated by, for example, a halogen atom, an aliphatic group, a cycloalkyl group, an aromatic group, an alkylthio group, a carbamoyl group, a cyano group, a formyl group, an aryloxy group, an acyloxy group, a carboxyl group or a salt thereof, a sulfo group or a salt thereof, an alkoxycarbonyl group, a cycloalkoxycarbonyl group, an aryloxycarbonyl group, $CORh_3$, $CORp_3$, $SO_2Rh_4$, $SO_2Rp_4$, $CONHRh_5$, $CONHRp_5$, $NHCORh_6$ and $NHCORp_6$, wherein $Rh_3$, $Rp_3$, $Rh_4$, $Rp_4$, $Rh_5$, $Rp_5$, $Rh_6$ and $Rp_6$ each represents an aliphatic group, an aromatic group or a heterocyclic group.

Typical examples of the compounds represented by the general formula (H) are specifically listed below:

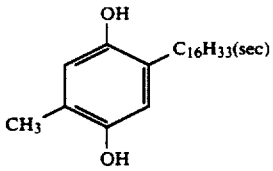

H-1

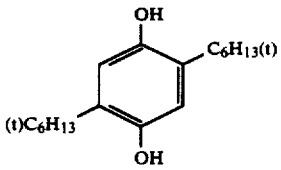

H-2

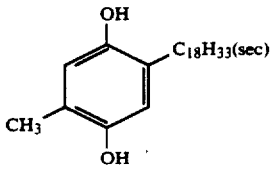

H-3

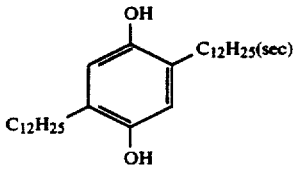

H-4

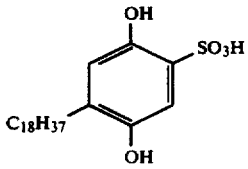

H-5

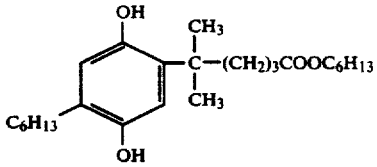

H-6

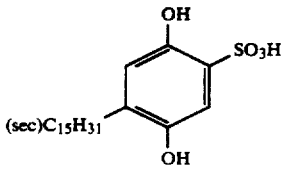

H-7

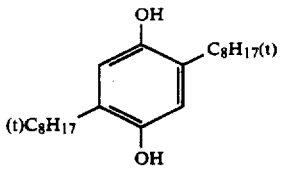

H-8

-continued

H-9

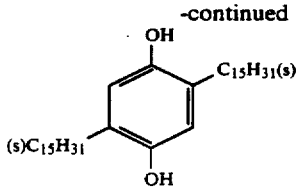

Typical examples of the compounds represented by the general formula (P) are specifically listed in the following tables:

| No. | $R^1$ | $R^2$ | $R^3$ | $R^4$ | $R^5$ | $R^6$ | $R^7$ | $R^8$ |
|---|---|---|---|---|---|---|---|---|
| | | | | 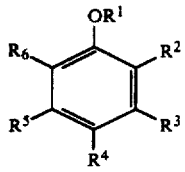 | | | | |
| P-1 | H | —OH | H | $-C_4H_9(t)$ | H | H | | |
| P-2 | H | —OH | H | 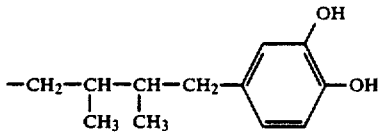 | H | H | | |
| P-3 | H | —OH | H | H | $C_8H_{17}(t)$ | H | | |
| P-4 | H | H | —OH | $-SO_3NH_4$ | H | H | | |
| P-5 | H | H | —OH | $C_8H_{17}$ | H | H | | |
| P-6 | H | OH | H | $COOC_{12}H_{25}$ | H | OH | | |
| P-7 | H | OH | H | $COOC_3H_7(iso)$ | H | OH | | |
| P-8 | H | OH | H | $CONHC_{12}H_{25}$ | H | OH | | |
| P-9 | H | OH | H | $CONH(CH_2)_3OC_{18}H_{37}$ | H | OH | | |
| P-10 | H | $OCH_3$ | H | COOH | H | $OCH_3$ | | |
| P-11 | H | $OCH_3$ | H | $COOC_{12}H_{25}$ | H | $OCH_3$ | | |
| | | | | 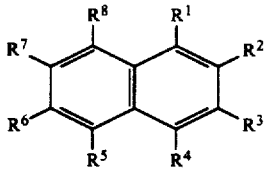 | | | | |
| P-12 | OH | OH | $C_2H_5$ | H | H | H | H | H |
| P-13 | OH | OH | H | $C_4H_9(t)$ | H | H | H | H |
| P-14 | OH | OH | H | H | H | $CH_3$ | H | H |
| P-15 | OH | OH | H | H | H | H | $C_{12}H_{25}$ | H |
| P-16 | OH | OH | H | H | H | H | H | $C_2H_5$ |
| P-17 | $C_4H_9(t)$ | OH | OH | H | H | H | H | H |
| P-18 | H | OH | OH | H | $CH_3$ | H | H | H |
| P-19 | H | OH | OH | H | H | H | $C_8H_{17}$ | H |
| P-20 | OH | $C_5H_{11}$ | OH | H | H | H | H | H |
| P-21 | OH | H | OH | $CH_3$ | H | H | H | H |
| P-22 | OH | H | OH | $C_4H_9(t)$ | H | H | H | H |

(S)

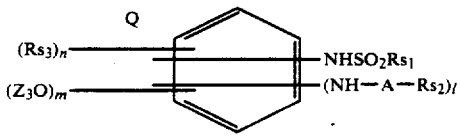

where A is —CO— or —$SO_2$—; $Rs_1$ and $Rs_2$ each represents an alkyl group, an aryl group, a heterocyclic group or an amino group; $Z_3$ is a hydrogen atom or an alkali decomposable precursor group; l is 1 or 2, provided that when l is 2, NH—A—$Rs_2$ may be the same or different; m is 0 or 1; at least one of —NH—A—$Rs_2$ and —$OZ_3$ is bonded in the position ortho or para to —NH-$SO_2Rs_1$; $Rs_3$ is a substituent; n is 0-6 and when n=2-6, $Rs_3$ may be the same or different; —Q— signifies that a naphthalene ring may be formed together with the benzene ring.

In formula (S), the alkyl group represented by $Rs_1$ and $Rs_2$ may be straight-chained or branched and preferably has 1-30 carbon atoms.

The aryl group represented by $Rs_1$ and $Rs_2$ preferably has 6-30 carbon atoms; the aryl group represented by $Rs_1$ and $Rs_2$ preferably has 6-30 carbon atoms; the heterocyclic group represented by $Rs_1$ and $Rs_2$ preferably has 5-30 carbon atoms, with at least one of oxygen and nitrogen being present as a hetero atom; the amino group represented by $Rs_1$ and $Rs_2$ may be substituted by an alkyl or aryl group.

In the alkali decomposable precursor group represented by Z, the hydrogen atom in the hydroxyl group is substituted with a blocking group that is eliminated upon contact with an alkali. A typical blocking group is one that can be eliminated by hydrolysis or intermolecular nucleophilic substitution. Typical examples of the blocking group that can be eliminated by hydrolysis include acyl groups such as aliphatic and aromatic carbonyl groups, and a sulfonyl group. Typical examples of the blocking group that can be eliminated by intermolecular nucleophilic substitution are described in U.S. Pat. No. 4,310,612.

The group represented by $Rs_2$ may have a substituent.

The compounds of formula (S) can be synthesized by any known method with reference being made to such patents as Unexamined Published Japanese Patent Application Nos. 5247/1984, 192247/1984, 195239/1984, 204040/1984, 108843/1985 and 118836/1985.

Specific examples of the compounds that can be used as sulfonylamino type DP' scavenger are listed below.

S-1

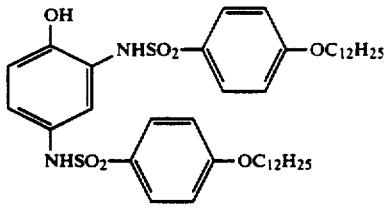

S-2

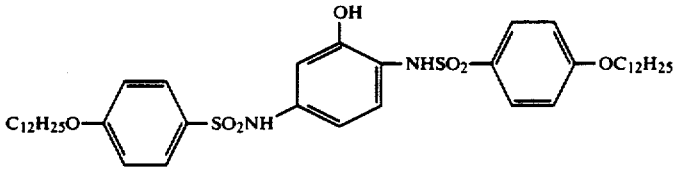

S-3

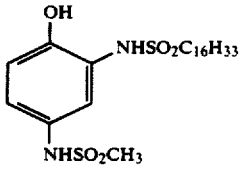

S-4

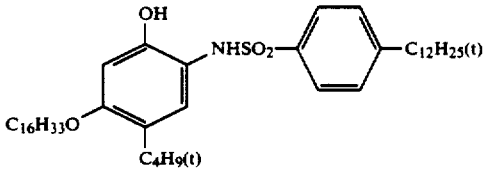

S-5

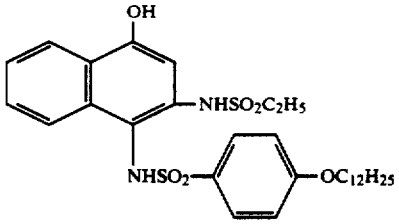

S-6

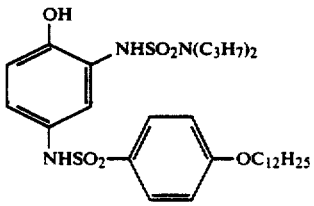

S-7

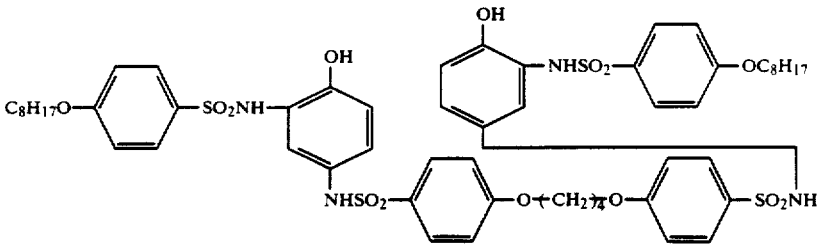

-continued
S-8
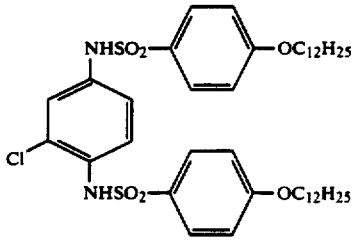
S-9
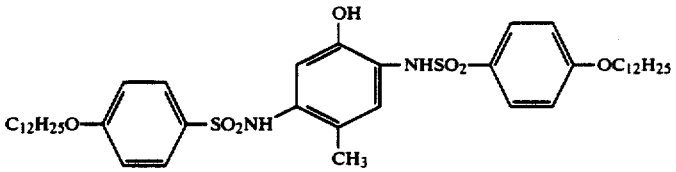
S-10
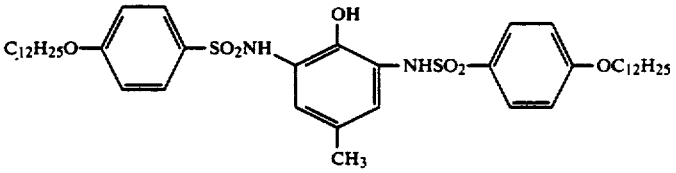
S-11
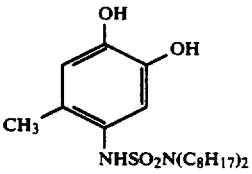
S-12
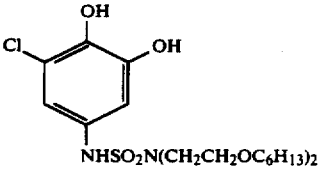
S-13
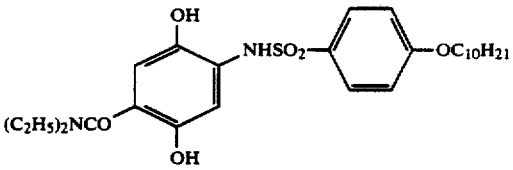
S-14
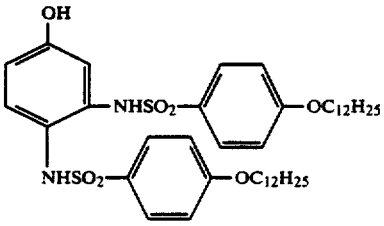
S-15
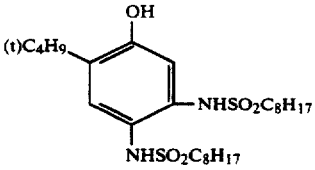

-continued

S-16

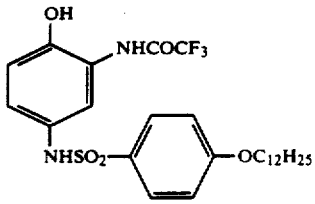

S-17

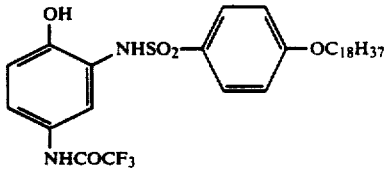

S-18

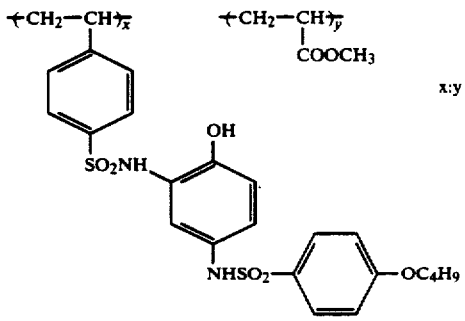

S-19

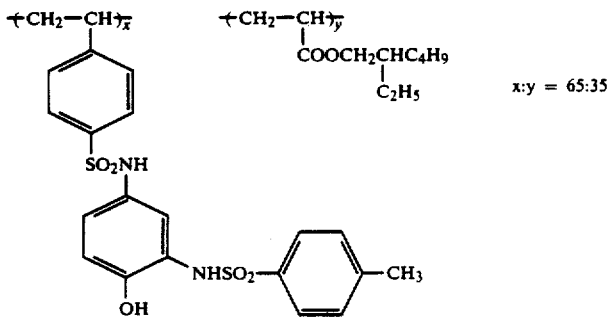

The coupling-type DP' scavenger represented by formula (C) includes following three sub-types of couplers:

(1) a coupler that couples with the oxidized product of a color developing agent to form a dye that dissolves in a processing solution;

(2) a coupler that couples with the oxidized product of a color developing agent but which remains in a leuco form; and (3) a coupler that couples with the oxidized product of a color developing agent to form a dye that has no pronounced absorption in the visible range of the spectrum and which provides a substantially colorless product.

Therefore, formula (C) is subdivided into formulas (C-i) (i=1,2, . . . , 13). The general formulas (C-i) include DP' scavengers that are particularly preferred for use in the present invention.

Compounds that belong to sub-type (1) may be represented by the following general formula (C-1):

$$\mathrm{COUP_1}\overset{*}{-}\mathrm{SOL} \qquad \text{(C-1)}$$
$$\mathrm{BALL}$$

where $COUP_1$ signifies a coupler nucleus having a coupling site (marked with the asterisk); BALL is a stabilizing group that is bonded to the coupling site of $COUP_1$ and which can be eliminated from $COUP_1$ by reaction with the oxidized product of a color developing agent, this group having a sufficient size and shape to render the compound of formula (C-1) non-diffusible; and SOL is a solubilizing group that is bonded to the non-coupling site of $COUP_1$ and which imparts mobility to the coupling product (i.e. the product formed as a result of coupling between $COUP_1$ and the oxidized product of a color developing agent) in such a way that it will flow out of the system of the light-sensitive material during color development or thereafter.

The coupler nucleus represented by $COUP_1$ may be selected from among all of the coupler nuclei that are either known on used in the art for the purpose of forming either colored or colorless reaction products by entering into coupling reaction with the oxidized product of a color developing agent. BALL is a stabilizing group that has a sufficient molecular size and shape to render the compound of formula (C-1) non-diffusible. While BALL is not limited to any particular group so long as it is capable of rendering the compound of formula (C-1) non-diffusible, useful examples include alkyl, aryl and heterocyclic groups, each having 8–32 carbon atoms.

The groups useful as BALL may be substituted and illustrative substituents are those which either increase the non-diffusibility of the compound (C-1) or change the reactivity of this compound, or which enter into coupling reaction and are eliminated from BALL. thereby increasing the diffusibility of BALL. It is also preferred that BALL is bonded to the coupling site of $COUP_1$ via a linkage.

The solubilizing group represented by SOL is a group that imparts to the coupling product (i.e., the product formed by coupling reaction) a sufficient degree of mobility to allow it to be dissolved away from the system of the light-sensitive material; illustrative examples include ionizable hydroxyl, carboxyl, sulfo and aminosulfonyl groups, as well as ionizable salts thereof and ester and ether groups thereof.

One or more of these groups are preferably bonded to the non-coupling site of $COUP_1$. It is also advantageous that solubilizing groups of a suitable size in which an alkyl group having 1–10 carbon atoms or an aryl group having 6–12 carbon atoms has one or more of the above-mentioned ionizable groups, are bonded to the non-coupling site of $COUP_1$. In another preferred case, the solubilizing group is bonded to the non-coupling site of $COUP_1$ via a linkage.

Particularly preferred solubilizing groups include a carboxy group, a sulfo group and ionizable salts thereof, which are directly bonded to the non-coupling site of $COUP_1$, as well as an alkyl group having 1–10 carbon atoms and an aryl group having 6–12 carbon atoms that have one or more carboxyl groups, sulfo groups or ionizable salts thereof, which are bonded to the non-coupling site of $COUP_1$ either directly or via an amino or carbonyl group.

DP' scavengers that are preferably used for the purpose of forming yellow, magenta and cyan dyes may be represented by the following general formulas (C-2) to (C-7):

Yellow dye forming compounds

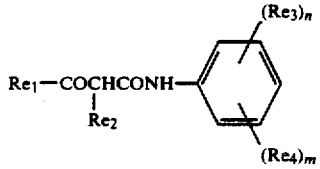

(C-2)

where $Rc_1$ is an aryl group or an alkyl group (in particular, a tertiary alkyl group); $Rc_2$ is a stabilizing group (BALL) as defined above; $Rc_3$ is a solubilizing group (SOL) as defined above; $Rc_4$ is a hydrogen atom, a halogen atom, an alkyl group or an alkoxy group; and $n+m<5$ (provided $n\neq0$ and $n\neq0$, and when each of n and m is 2 or more, $Rc_3$ and $Rc_4$ may be the same or different).

Magenta dye forming compounds

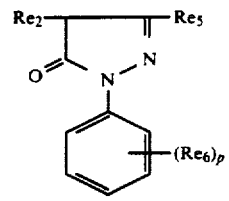

(C-3)

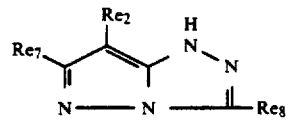

(C-4)

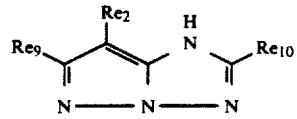

(C-5)

where $Rc_{2\,pl}$ *has the same meaning as* $Rc_2$ in formula (C-2) $Rc_5$ is a solubilizing group (SOL); $Rc_6$ is a hydrogen atom, a halogen atom, an alkyl group, an alkoxy group or an amino group; $p<5$ (provided $p\neq0$, and when p is 2 or more, $Rc_6$ may be the same or different); one of $Rc_7$ and $Rc_8$ represents a solubilizing group (SOL) as defined above and other is a hydrogen atom, an alkyl group, an alkoxy group, an aryl group or an amino group; $Rc_9$ and $Rc_{10}$ have the same meanings as $Rc_7$ and $Rc_8$ in formula (C-4).

Cyan dye forming compounds

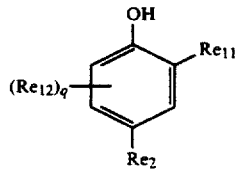

(C-6)

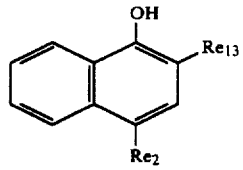

(C-7)

where $Rc_2$ has the same meaning as $Rc_2$ in formula (C-2); at least one of $Rc_{11}$ and $Rc_{12}$ is a solubilizing group (SOL) as defined above and the other is a hydrogen atom, a halogen atom, an alkyl group, an alkoxy group or an alkylamido group; $q<3$ (but $q\neq0$); $Rc_{13}$ is a solubilizing group (SOL) as defined above.

Unless otherwise noted, the alkyl, alkoxy and alkylamido groups in formulas (C-2) to (C-7) each contains 1–8 carbon atoms; the aryl group contains 6–10 carbon atoms; and the amino group may be primary, secondary or tertiary. These substituents and the stabilizing group (BALL) may have such substituents as a halogen atom, or hydroxyl, carboxyl, amino, amido, carbamoyl, sulfamoyl, sulfonamido, alkyl, alkoxy and aryl groups.

An example of the compound belonging to sub-type (2) may be represented by the following general formula (C-8):

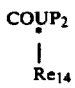

(C-8)

where $COUP_2$ has the same meaning as $COUP_1$ in formula (C-1); and $Rc_{14}$ is a group that is bonded to the coupling site of $COUP_2$ and which is not capable of being eliminated upon reaction between the coupler of formula (C-8) and the oxidation product of a color developing agent.

The coupler nucleus represented by $COUP_2$ may be exemplified by the coupler nuclei given in connection with formula (C-1).

The group represented by $Rc_{14}$ may be illustrated by an alkyl group, a substituted alkyl group, an aryl group, a substituted aryl group, an alkenyl group and a cyano group.

The compound represented by formula (C-8) is preferably rendered non-diffusible by an alkyl, aryl or heterocyclic group each having 8–32 carbon atoms that is bonded to the coupler nucleus $COUP_2$ at the non-coupling site via a linkage.

An example of the compound belonging to sub-type (3) may be represented by the following general formula (C-9):

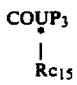

(C-9)

where $COUP_3$ represents a coupler nucleus that yields a substantially colorless product upon coupling reaction with the oxidation product of a color developing agent; and $Rc_{15}$ represents a group that is bonded to the coupling site of $COUP_3$ and which is capable of being eliminated from $COUP_3$ upon coupling reaction with the oxidation product of a color developing agent.

More preferred examples of the compound of formula (C-9) may be represented by the following general formulas (C-10) to (C-13):

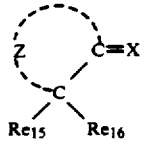

(C-10)

where $Rc_{15}$ has the same meaning as $Rc_{15}$ in formula (C-9); $Rc_{16}$ is a hydrogen atom, a halogen atom, an alkyl group, an aryl group, an alkoxy group, an acyloxy group or a heterocyclic group; X is an oxygen atom or $=N-Rc_{17}$ (where $Rc_{17}$ is an alkyl group, an aryl group, a hydroxyl group, an alkoxy group or a sulfonyl group); Z represents the group of nonmetallic atoms necessary for forming a 5- to 7-membered carbon ring (e.g., indanone, cyclopentanone or cyclohexanone) or heterocyclic ring (e.g., piperidone, pyrrolidone or hydrocarbostyryl).

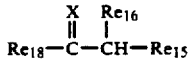

(C-11)

where $Rc_{15}$, $Rc_{16}$ and X have the same meanings as $Rc_{15}$, $Rc_{16}$ and X in formula (C-10); $Rc_{18}$ is an alkyl group, an aryl group, a heterocyclic group, a cyano group, a hydroxyl group, an alkoxy group, an aryloxy group, a heterocyclic oxy group, an alkylamino group, a dialkylamino group or an anilino group.

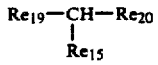

(C-12)

where $Rc_{15}$ has the same meaning as $Rc_{15}$ in formula (C-9); $Rc_{19}$, $Rc_{20}$ which may be the same or different each represents an alkoxycarbonyl group, a carbamoyl group, an acyl group, a cyano group, a formyl group, a sulfonyl group, a sulfinyl group, a sulfamoyl group, an ammonium group or

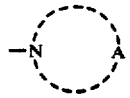

(where A signifies the group of non-metallic atoms necessary for forming a 5- to 7-membered heterocyclic ring (e.g., phthalimide, triazole or tetrazole) together with the nitrogen atom.

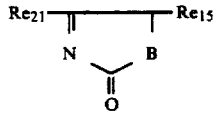

(C-13)

where $Rc_{15}$ has the same meaning as $Rc_{15}$ in formula (C-9); $Rc_{21}$ is an alkyl group, an aryl group, an anilino group, an alkylamino group or an alkoxy group; B is an oxygen atom, a sulfur atom or an imino group.

The compounds represented by formulas (C-1) to (C-13) can be synthesized by known methods such as those described in Unexamined Published Japanese Patent Application Nos. 113440/1984, 171955/1984, 82423/1977, BP 914,145, 1,284,649, USP 2,742,832, 3,227,550, 3,928,041, 3,958,993, 3,961,959, 4,046,574, 4,052,231 and 4,149,886.

The following are typical examples of the coupling-type DP' scavengers but it should be understood that these are not the sole examples of this type of DP' scavengers.

Compounds of subtype (1):

-continued
C-1
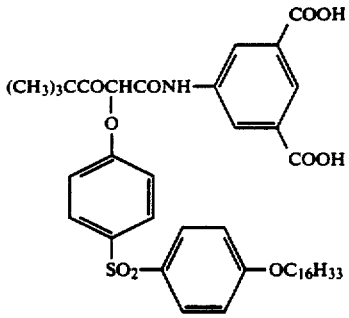
C-2
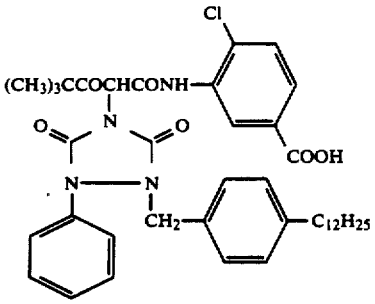
C-3
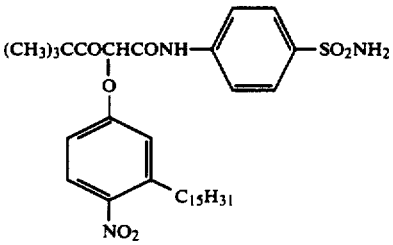
C-4
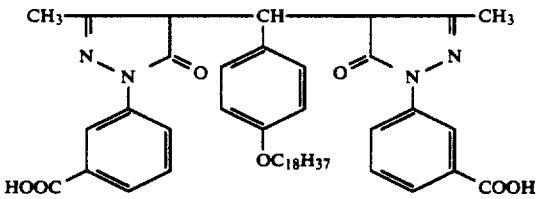
C-5
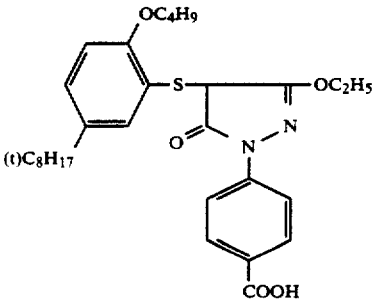

-continued
C-6
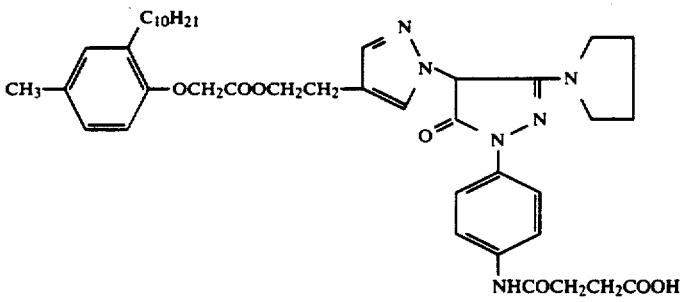
C-7
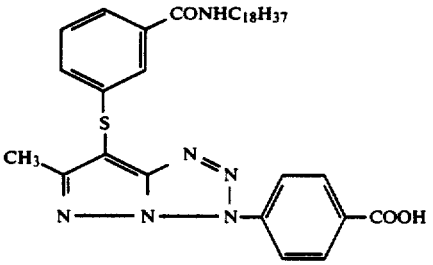
C-8
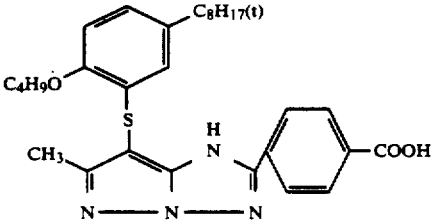
C-9
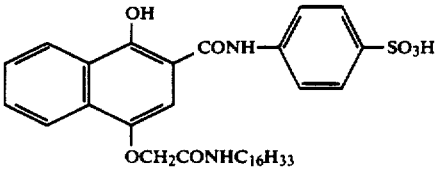
C-10
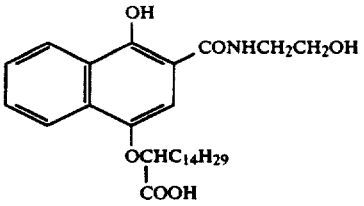
C-11
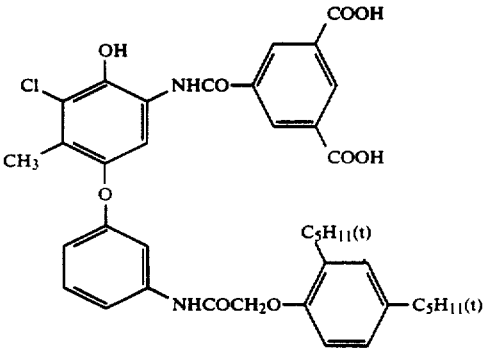

-continued
C-12
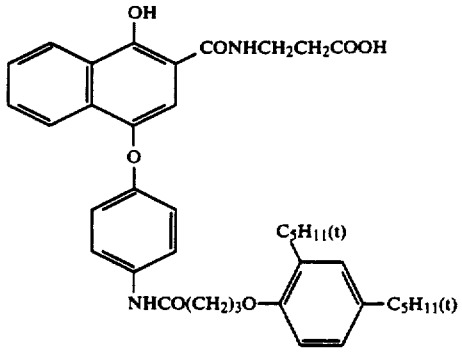
C-13
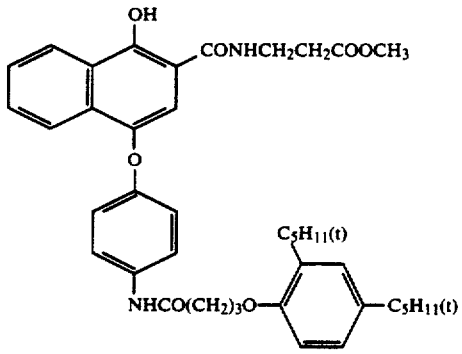
C-14
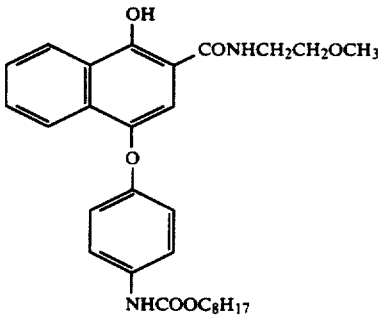
Compounds of subtype (2):
C-15
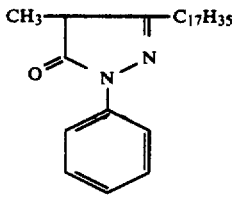
C-16
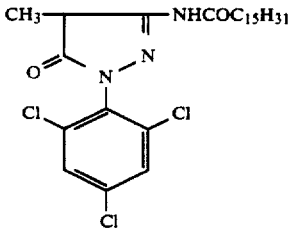

-continued

C-17

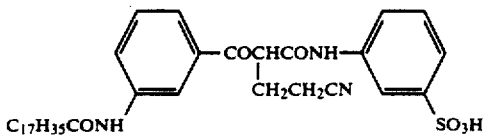

Compounds of subtype (3):

C-18

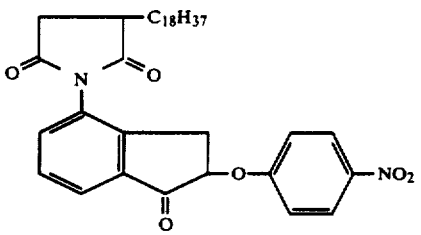

C-19

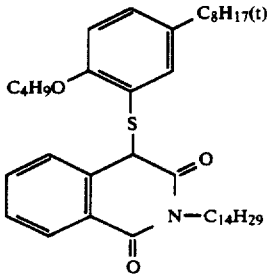

C-20

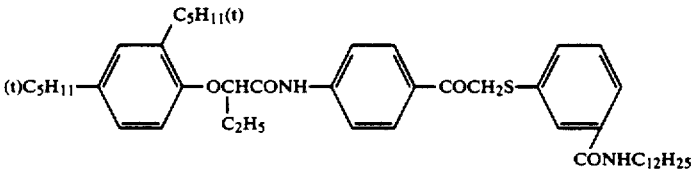

C-21

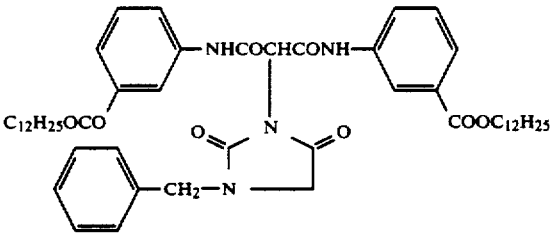

C-22

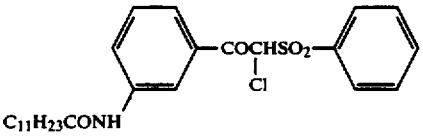

C-23

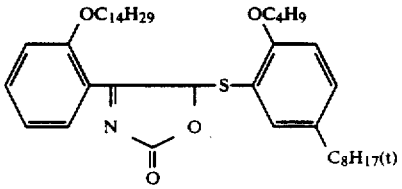

In the most preferred case, the DP' scavengers are directly incorporated in silver halide emulsion layers. They may also be incorporated in non-light-sensitive layers such as intermediate layers, protective layers, yellow filter layers, and anti-halation layers.

The DP' scavengers, if they are to be incorporated in silver halide emulsion layers, are preferably used in amounts in the range of $1\times10^{-6}-1\times10^{-1}$ mole per $m^2$, with the range of $1\times10^{-5}-2\times10^{-3}$ moles per $m^2$ being particularly preferred. It should, however, be noted that the exact amount of the DP' scavenger to be added should be properly determined in consideration of the type of silver halide and scavenger compound used. If the DP' scavengers are to be incorporated in layers containing no silver halide such as intermediate layers, protective layers, yellow filter layers and antihalation layers, they are preferably used in amounts ranging from $1\times10^{-6}$ to $1\times10^{-2}$ mole per $m^2$, more preferably from $1\times10^{-5}$ to $1\times10^{-3}$ mole per $m^2$.

The DP' scavengers may be incorporated in emulsion layers or other photographic layers by known methods such as the one described in U.S. Pat. No. 2,322,027.

The color photographic material of the present invention may be employed to produce a variety of photographic products such as color negative films, color positive films, color reversal films, and color photographic papers. The advantages of the present invention are exhibited most effectively when this photographic material is used as a reversal film which is to be processed with a color developer having a pH of 11 and more.

Any conventional silver halide emulsion may be employed in the light-sensitive material of the present invention. The silver halide emulsions to be used in the present invention may be chemically sensitized by standard methods. Alternatively, they may be optically sensitized to a desired wavelength range with sensitizing dyes.

Anti-foggants, stabilizers and other photographic addenda may be added to these silver halide emulsions. Gelatin is advantageously used as a binder for the emulsions.

Emulsion layers and other hydrophilic colloidal layers may be hardened; they may also incorporate plasticizers or dispersions (latices) of water-insoluble or slightly water-soluble synthetic polymers.

Couplers are incorporated in emulsion layers in the color photographic material of the present invention. Competitive couplers having color correcting effects may also be incorporated in emulsion layers. In addition, compounds which, upon coupling with the oxidized product of a color developing agent, release photographically useful fragments such as development accelerators, bleach accelerators, developers, silver halide solvents, tone conditioners, hardeners, foggants, anti-foggants, chemical sensitizers, spectral sensitizers and desensitizers, may also be used.

The light-sensitive material may incorporate auxiliary layers such as filter layers, anti-halation layers, and anti-irradiation layers. These layers and/or emulsion layers may incorporate dyes that either dissolve away from the light-sensitive material during development or undergo bleaching.

Other additives that can be incorporated in the light-sensitive material include matting agents, lubricants, image stabilizers, formaldehyde scavengers, ultraviolet absorbers, brighteners, surfactants, development accelerators, development retarders, and bleach accelerators.

Supports or bases that can be used with the color photographic material of the present invention include paper laminated with polyethylene or other suitable polymers, polyethylene terephthalate films, baryta paper, and triacetyl cellulose.

In order to produce dye images with the light-sensitive material of the present invention, known procedures of color photographic processing may be performed after exposure.

Color reversal processing is performed after exposure to obtain reversal dye images using the light-sensitive material of the present invention. Color reversal processing consists basically of a black-and-white development step, a fogging step, a color development step, and desilvering step (bleach step, and/or fixing step).

Additional steps such as washing step or stabilizing step may be included if desired.

Two or more steps may be grouped and conducted at a time.

A prehardening step, neutralizing step, stop-fix step or posthardening step may be performed in combination with the above-listed processing steps.

The black-and-white developer generally comprises an alkaline aqueous solution containing a known black-and-white developing agent.

Fogging is achieved either by treatment with a solution containing a chemical foggant or by irradiation with light or by both. Illustrative foggants are stannous chloride and tertiary butylaminoborane. Fogging is effected either prior to or simultaneously with color development. In the latter case, the foggant is incorporated in the color developer.

The color developer generally comprises an aqueous alkali solution containing a color developing agent. The color developing agent is an aromatic primary amine color developing agent, such as aminophenol-based and p-phenylene-diamine derivatives.

These compounds are generally used in amounts in the range from about 0.1 to 30 g, more preferably in amounts in the range from about 1 to 15 g, per 1,000 ml of color developer.

The color developer may contain a variety of additives that are usually incorporated in developers, such as an alkali agent, benzyl alcohol, an alkali metal halide, a conditioner, a preservative, an anti-foaming agent, a surfactant, and an organic solvent.

The color developer used in the present invention has a pH of 11 or higher.

The color developer may further contain an anti-oxidation agent.

The bleach step may be performed simultaneously with the fixing step or separately. Exemplary bleaching agents include metal complex salts of various organic acids.

Fixers of generally employed compositions may be employed.

Exemplary bleaching agents that may be used in the bleaching fix bath include the metal complex salts of organic acids in the aforementioned bleach step.

The following examples are provided for the purpose of further illustrating preferred embodiments of the present invention but are in no way to be taken as limiting. In the following examples, unless otherwise noted, the indication of the amounts of sensitizing dyes and couplers is in terms of one mole of silver halide.

EXAMPLE 1

Sample No. 1 of multilayered color photographic material was prepared by coating a subbed triacetyl cellulose film base with the following layers in the given order, the first layer being disposed just above the base.

First layer: Anti-halation layer

UV absorber-1; 0.3 g/$m^2$; UV absorber-2, 0.4 g/$m^2$; black colloidal silver, 0.24 g/$m^2$; gelatin, 2.7 g/$m^2$ Second layer: Intermediate layer DP' scavenger (H-8), 0.1 g/m$^2$; gelatin, 1.0 g/m$^2$ Third layer: Less red-sensitive silver halide emulsion layer Core/shell type monodispersed emulsion (Em-I) with low surface iodine content having an average grain size ($\bar{r}$) of 0.3 μm and consisting of AgBrI (4 mol % AgI): silver deposit, 0.5 g/m$^2$
Sensitizing dye-1, $6.6\times10^{-4}$ moles
Sensitizing dye-2, $1.3\times10^{-4}$ moles
Coupler-1, 0.1 mole
Gelatin, 1.75 g/m$^2$ Fourth layer: Highly red-sensitive silver halide emulsion layer Core/shell type monodispersed emulsion (Em-II) with low surface iodine content having an average grain size ($\bar{r}$) of 0.7 μm and consisting of AgBrI (3 mol % AgI):
silver deposit, 0.8 g/m$^2$
Sensitizing dye-1, $2.8\times10^{-4}$ moles
Sensitizing dye-2, $0.6\times10^{-4}$ moles
Coupler-1, 0.2 moles
Gelatin, 1.75 g/m$^2$ Fifth layer: Intermediate layer
DP' scavenger (H-8), 0.1 g/m$^2$
Gelatin, 0.9 g/m$^2$ Sixth layer: Less green-sensitive silver halide emulsion layer
Em-I: silver deposit, 1.0 g/m$^2$
Sensitizing dye-3, $6.6\times10^{-4}$ moles
Sensitizing dye-4, $0.6\times10^{-4}$ moles
Coupler-2, 0.05 moles
Gelatin, 1.5 g/m$^2$
DP' scavenger (H-8), $1.6\times10^{-4}$ moles/m$^2$ Seventh layer: Highly green-sensitive silver halide emulsion layer
Em-II: silver deposit, 1.0 g/m$^2$
Sensitizing dye-3, $2.76\times10^{-4}$ moles
Sensitizing dye-4, $0.23\times10^{-4}$ moles
Coupler-2, 0.15 moles
Gelatin, 1.5 g/m$^2$
DP' scavenger (H-8), $1.6\times10^{-4}$ moles/m$^2$ Eighth layer: Yellow filter layer
Yellow colloidal silver, 0.1 g/m$^2$
Gelatin, 0.9 g/m$^2$
DP' scavenger (H-8), 0.1 g/m$^2$ Ninth layer: Less blue-sensitive silver halide emulsion layer Core/shell type monodispersed emulsion (Em-III) with low surface iodine content having an average grain size ($\bar{r}$) of 0.6 μm and consisting of AgBrI (3 mol % AgI): silver deposit, 0.4 g/m$^2$
Coupler-3, 0.3 moles
Gelatin, 1.4 g/m$^2$ Tenth layer: Highly blue-sensitive silver halide emulsion layer
Core/shell type monodispersed emulsion (Em-IV) with low surface iodine content having an average grain size ($\bar{r}$) of 1.0 μm and consisting of AgBrI (3 mol % AgI): silver deposit, 0.8 g/m$^2$
Coupler-3, 0.3 moles
Gelatin, 1.45 g/m$^2$ Eleventh layer: First protective layer
UV absorber-1, 0.3 g/m$^2$; UV absorber-2, 0.4 g/m$^2$
gelatin, 1.2 g/M$^2$; DP' scavenger (H-8), 0.1 g/m$^2$ Twelve layer: Second protective layer
Non-light-sensitive, fine-grained silver halide emulsion with an average grain size ($\bar{r}$) of 0.06 μm and containing 1 mol % AgI: silver deposit, 0.3 g/m$^2$
Polymethyl methacrylate particles (diameter, 1.5 μm)
Gelatin, 0.7 g/m$^2$
Surfactant-1.

In addition to the compounds mentioned above, gelatin hardener-1 and a surfactant were incorporated in each of the layers. Tricresyl phosphate was used as a solvent for each coupler.

Sample Nos. 2-26 were prepared in the same manner as described above except that the coupler and DP' scavenger in the sixth and seventh layers were changed to those listed in Table 1. The couplers were used in equimolar amounts.

Compounds used in Sample Nos. 1-26

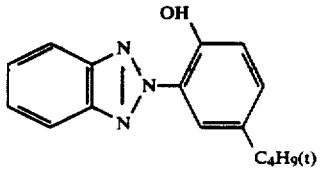

UV absorber-1

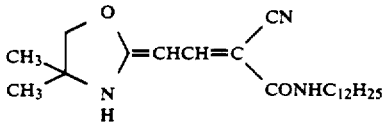

UV absorber-2

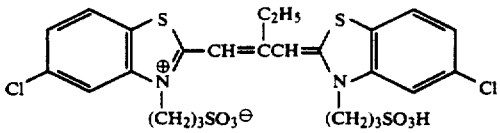

Sensitizing dye-1

-continued
Compounds used in Sample Nos. 1-26
Sensitizing dye-2
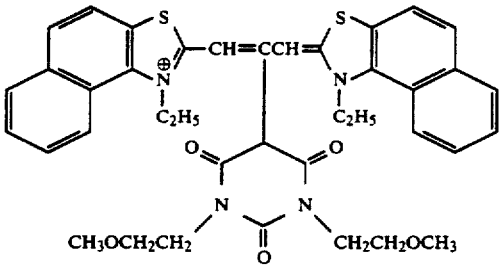
Sensitizing dye-3
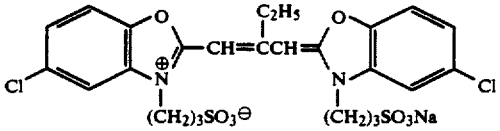
Sensitizing dye-4
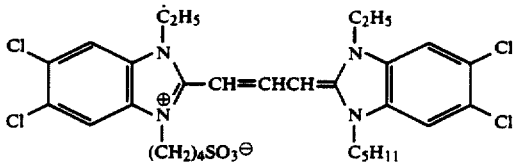
Coupler-1
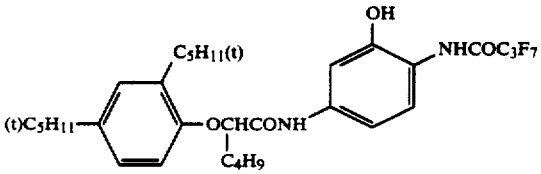
Coupler-2
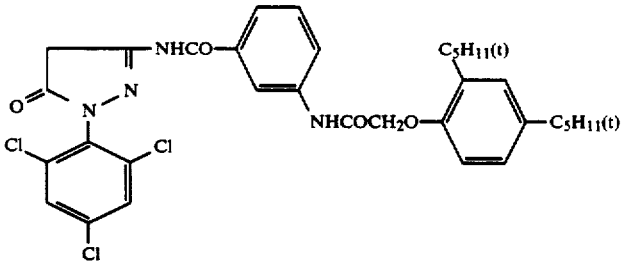
Coupler-3
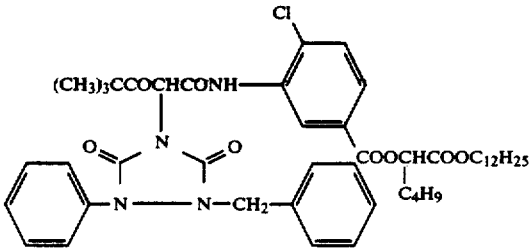
Coupler-4
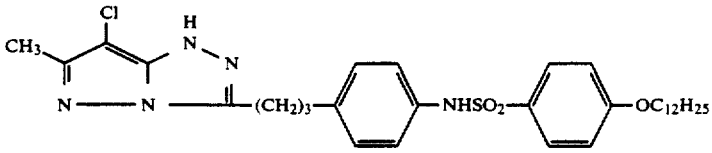

Compounds used in Sample Nos. 1-26

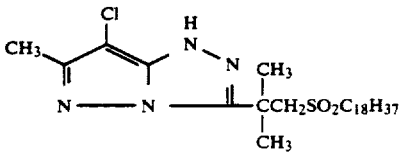

Coupler-5

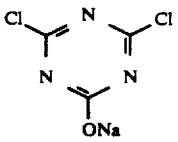

Gelatin hardener-1

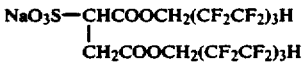

Surfactant-1

Sample Nos. 1-26 were exposed to white light through an optical wedge and subsequently processed by the following scheme.

| Steps | Time (min) | Temperature (°C.) |
|---|---|---|
| First development | 6 | 38 ± 0.3 |
| Rinse | 2 | " |
| Reversal | 2 | " |
| Color development | 6 | " |
| Conditioning | 2 | " |
| Bleaching | 6 | " |
| Fixing | 4 | " |
| Rinse | 4 | R.T. |
| Stabilizing | 1 | |
| Drying | | |

The following solutions were used in the photographic processing of sample Nos. 1-26.

| | |
|---|---|
| First developer | |
| Sodium tetrapolyphosphate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% sol.) | 2 ml |
| Water | to make 1,000 ml |
| Reversal solution | |
| Nitrilotrimethylene phosphonic acid hexasodium salt | 3 g |
| Stannous chloride (dihydrate) | 1 g |
| p-Aminophenol | 0.1 g |
| Sodium hydroxide | 8 g |
| Glacial acetic acid | 15 ml |
| Water | to make 1,000 ml |
| Color developer (pH, 11.8) | |
| Sodium tetrapolyphosphate | 2 g |
| Sodium sulfite | 7 g |
| Tribasic sodium phosphate ($2H_2O$) | 36 g |
| Potassium bromide | 1 g |

-continued

| | |
|---|---|
| Potassium iodide (0.1% sol.) | 90 ml |
| Sodium hydroxide | 3 g |
| Citrazinic acid | 1.5 g |
| N-Ethyl-N-β-methanesulfonamido-ethyl-3-methyl-4-aminoaniline sulfate | 11 g |
| Ethylenediamine | 3 g |
| Water | to make 1,000 ml |
| Conditioning solution | |
| Sodium sulfite | 12 g |
| Ethylenediaminetetraacetic acid sodium salt ($2H_2O$) | 8 g |
| Thioglycerin | 0.4 ml |
| Glacial acetic acid | 3 ml |
| Water | to make 1,000 ml |
| Bleaching solution | |
| Ethylenediaminetetraacetic acid sodium salt ($2H_2O$) | 2 g |
| Ethylenediaminetetraacetic acid iron (II) ammonium salt ($2H_2O$) | 120 g |
| Potassium bromide | 100 g |
| Water | to make 1,000 ml |
| Fixing solution | |
| Ammonium thiosulfate | 80 g |
| Sodium sulfite | 5 g |
| Sodium bisulfite | 5 g |
| Water | to make 1,000 ml |
| Stabilizing solution | |
| Formaldehyde (37 wt % aq. sol.) | 5 ml |
| Konidax (product of Konishiroku Photo Industry Co., Ltd.) | 5 ml |
| Water | to make 1,000 ml |

The samples so processed were evaluated for their granularity and desilvering efficiency. The results are summarized in Table 1.

Granularity is expressed as 1,000 times the standard deviation of the variation in density which occurs when a magenta image having a density of 1.0 is scanned with a microdensitometer having a scanning aperture with a surface area of 250 $\mu m^2$. Desilvering property is expressed as the mean average of measurements conducted by X-ray fluoroscopy of the residual silver deposit in a tested image area.

TABLE 1

| Sample No. | Sixth and seventh layers: coupler | DP' scavenger: type | DP' scavenger: amount* | Granularity (rms) | Residual silver deposit ($mg/dm^2$) |
|---|---|---|---|---|---|
| Comparative samples | | | | | |
| 1 | coupler 2 | H-8 | 1 | 30 | 12.5 |
| 2 | coupler 2 | H-8 | ½ | 32 | 5.1 |

TABLE 1-continued

| Sample No. | Sixth and seventh layers coupler | DP' scavenger type | DP' scavenger amount* | Granularity (rms) | Residual silver deposit (mg/dm²) |
|---|---|---|---|---|---|
| 3 | coupler 2 | H-8 | — | 35 | 0.1 |
| 4 | coupler 4 | H-8 | 1 | 57 | 1.2 |
| 5 | coupler 5 | H-8 | 1 | 52 | 0.8 |
| Samples of the invention | | | | | |
| 6 | compound 4 | " | 1 | 29 | 0 |
| 7 | compound 10 | " | 1 | 27 | 0 |
| 8 | " | " | 2 | 25 | 0 |
| 9 | " | " | ½ | 29 | 0 |
| 10 | " | " | ⅓ | 31 | 0 |
| 11 | " | H-1 + H-3 (1:1) | 1 | 28 | 0 |
| 12 | " | H-2 | 1 | 27 | 0 |
| 13 | " | H-4 | 1 | 28 | 0 |
| 14 | " | P-6 | 1 | 26 | 0 |
| 15 | " | P-15 | 1 | 29 | 0 |
| 16 | " | S-1 | 1 | 26 | 0 |
| 17 | " | S-3 | 1 | 28 | 0 |
| 18 | " | C-1 | 1 | 28 | 0 |
| 19 | " | C-12 | 1 | 27 | 0 |
| 20 | compound 11 | H-8 | 1 | 27 | 0 |
| 21 | compound 12 | " | 1 | 28 | 0 |
| 22 | compound 21 | " | 1 | 27 | 0 |
| 23 | compound 22 | " | 1 | 28 | 0 |
| 24 | compound 48 | " | 1 | 28 | 0 |
| 25 | compound 10 | H-8 (only in 7th layer) | 1 | 29 | 0 |
| 26 | compound 10 | H-8 (only in 6th layer) | 1 | 30 | 0 |

*In terms of molar ratio to coupler

As is clear from Table 1, sample Nos. 1 and 2 which contained a 5-pyrazolone based magenta coupler and a DP' scavenger in the same emulsion layer had poor desilvering properties. Sample Nos. 4 and 5 which used a DP' scavenger in combination with a pyrazoloazole based magenta coupler outside the scope of the present invention had comparatively good desilvering properties but, on the other hand, they had increased granularity. In contrast, sample Nos. 6–26 of the present invention which contained DP' scavengers and magenta couplers, both within the scope of the present invention, were improved in terms of both granularity and desilvering properties. The couplers used in these samples of the present invention also achieved good color reproduction since they had a smaller degree of secondary absorption in the blue region than a conventional 5-pyrazolone based magenta coupler.

EXAMPLE 2

A monochromatic color photographic material (sample No. 27) was prepared by coating a subbed triacetyl cellulose film with the following layers in the given order, with the first layer being disposed just above the base.

First layer: Anti-halation layer

The same as the anti-halation layer in sample No. 1.

Second layer: Intermediate layer

The same as the second layer in sample No. 1.

Third layer: Less green-sensitive silver halide emulsion layer

The same as the sixth layer in sample No. 1.

Fourth layer: Highly green-sensitive silver halide emulsion layer

The same as the seventh layer in sample No. 1.

Fifth layer: Protective layer

A layer containing 1.0 g/m² of gelatin.

Sample Nos. 28 and 29 were prepared as described above except that comparative magenta coupler 2 in the third and fourth layers was replaced by equimolar amounts of comparative coupler 4 and a coupler within the scope of the present invention (compound 22), respectively.

As in Example 1, the three additional samples were exposed to white light through an optical wedge. Thereafter, each exposed sample was processed with the pH of a color developer varied at four different values. The color developer had the same formulation as what was used in Example 1. The results of measurements of color density and sensitivity obtained from each sample are summarized in Table 2. The color density is expressed in terms of the density of the unexposed area, and the sensitivity is expressed in relative values with the sensitivity of the area having a color image density of 1.0 at a color developer's pH of 11.8 being taken as 100.

TABLE 2

| Sample No. | Magenta coupler | Color density as a function of pH 10.5 | 11.0 | 11.8 | 12.5 | Sensitivity |
|---|---|---|---|---|---|---|
| 27 (Comparative sample) | Coupler 2 | 2.70 | 3.00 | 2.80 | 2.40 | 100 |
| 28 (Comparative sample) | Coupler 4 | 2.30 | 3.20 | 3.35 | 3.50 | 64 |
| 29 (Sample of the | Compound 22 | 2.10 | 2.70 | 3.00 | 3.10 | 100 |

TABLE 2-continued

| Sample No. | Magenta coupler | Color density as a function of pH 10.5 | 11.0 | 11.8 | 12.5 | Sensitivity |
|---|---|---|---|---|---|---|
| invention) | | | | | | |

As is clear from Table 2, sample No. 29 using a coupler within the scope of the present invention achieved high image densities and yet suffered no decrease in sensitivity even when it received a color development at pHs of 11.0 and above. In addition, this sample exhibited good desilvering efficiency and satisfactory color reproduction.

What is claimed is:

1. A method for processing a silver halide photographic material comprising:

1. treating silver halide photographic material with a black and white developer;
2. fogging said silver halide photographic material;
3. processing said silver halide photographic material with a color developer having a pH of at least 11, wherein said color developer contains a color developing agent; and
4. desilvering said silver halide photographic material, wherein said silver halide photographic material comprises a coupler represented by Formula (M-I)

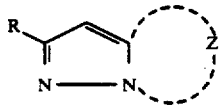

Formula (M-I)

wherein R is hydrogen or a substituent, and Z signifies the group of non-metallic atoms necessary for forming a nitrogenous heterocyclic ring, provided that the ring formed by Z has a substituent represented by the formula $$-R_{12}-SO_2-R_{13} \quad \text{(M-X)}$$

where $R_{12}$ is an alkylene group; and $R_{13}$ is an alkyl group, a cycloalkyl group or an aryl group; R is a hydrogen atom or a substituent; and a compound that reacts with an oxidized product of said color developing agent and which substantially lacks the ability to impart an image density represented by the following formulae (H), (P), (S), (C-1), (C-8) or (C-9):

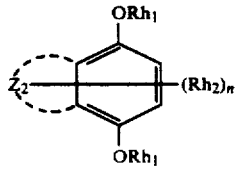

(H)

where $Rh_1$ is a hydrogen atom, an aliphatic group or an acyl group; $Rh_2$ is a monovalent group; n is an integer of 0–6, provided that when n is 2 or more, $Rh_2$ may be the same or different; and $Z_2$ signifies an atomic group capable of completing a benzene ring or an atomic group capable of forming a naphthalene ring together with the benzene ring;

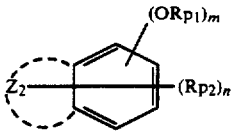

(P)

where $Rp_1$ and $Rp_2$ have the same meaning as $Rh_1$ and $Rh_2$; m is 2 or 3; when m=2, the two —$ORp_1$ are on an ortho or meta position, and m=3, the three —$ORp_1$ are bonded to mutually adjacent sites, provided that in each case —$ORp_1$ may be the same or different; n is an integer of 0–6, provided that when n is 2 or more, $Rp_2$ may be the same or different;

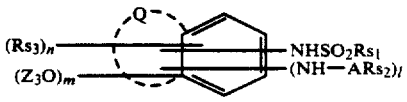

(S)

where A is —CO— or —$SO_2$—; $Rs_1$ and $Rs_2$ each represents an alkyl group, an aryl group, a heterocyclic group or an amino group; $Z_3$ is a hydrogen atom or an alkali decomposable precursor group; $Rs_3$ is a substituent; Q has the same meaning as $Z_2$, l is 1 or 2, provided that when l=2, —NH—A—$Rs_2$ may be the same or different; m is 0 or 1 and n is an integer of 0–6, provided that when n is 2 or more, $Rs_3$ may be the same or different; and at least one of —NH—A—$Rs_2)_l$ and —$OZ_3)_m$ is bonded in the position ortho or para to —NH-$SO_2Rs_1$;

$$\underset{\underset{\text{BALL}}{|}}{\overset{*}{\text{COUP}_1}}\text{—SOL} \quad \text{(C-1)}$$

where $COUP_1$ signifies a coupler nucleus having a coupling site (marked with the asterisk); BALL is a stabilizing group that is bonded to the coupling site of $COUP_1$ and which can be eliminated from $COUP_1$ by reaction with the oxidized product of a color developing agent, this stabilizing group having a sufficient size and shape to render the compound of Formula (C-1) non-diffusible; and SOL is a solubilizing group that is bonded to the non-coupling site of $COUP_1$ and which imparts mobility to the product formed as a result of coupling between $COUP_1$ and the oxidized product of a color developing agent;

$$\underset{\underset{Re_{14}}{|}}{\overset{*}{\text{COUP}_2}} \quad \text{(C-8)}$$

where $COUP_2$ has the same meaning as $COUP_1$; and $Re_{14}$ is a group that is bonded to the coupling site of $COUP_2$ and which is not capable of being eliminated upon reaction between the compound of formula (C-8) and the oxidation product of a color developing agent; and

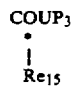

(C-9)

where $COUP_3$ represents a coupler nucleus that yields a substantially colorless product upon coupling reaction with the oxidized product of a color developing agent; and $Re_{15}$ represents a group that is bonded to the coupling site of $COUP_3$ and which is capable of being eliminated from $COUP_3$ upon coupling reaction with the oxidized product of a color developing agent.

2. The method of claim 1 wherein said coupler is a compound represented by the following general formula (M-VIII):

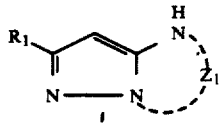

(M-VIII)

where $R_1$ and $Z_1$ have the same meaning as R and Z, respectively, in the formula (M-I).

3. The method of claim 2 wherein said coupler is a compound represented by the following general formula (M-II):

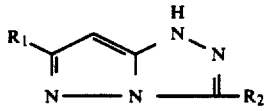

(M-II)

where $R_1$ and $R_2$ each has the same meaning as R in formula (M-I).

4. The method of claim 1 wherein R in formula (M-I) is a group represented by the following general formula (M-IX):

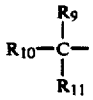

(M-IX)

where $R_9$–$R_{11}$ each has the same meaning as R in formula (M-I).

5. The method of claim 1 wherein said coupler is incorporated in at least one of said silver halide emulsion layers in an amount in the range of from $1\times10^{-3}$ to 1 mole per mole of silver halide.

6. The method of claim 5 wherein said coupler is incorporated in at least one of said silver halide emulsion layers in an amount in the range of from $1\times10^{-2}$ to $8\times10^{-1}$ moles per mole of silver halide.

7. The method of claim 1 wherein the compound represented by formula (C-1) is specifically represented by either one of the following general formulas (C-2) to (C-7):

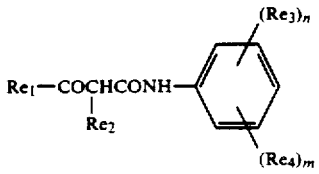

(C-2)

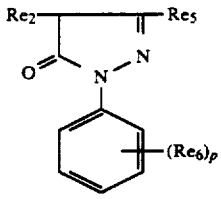

(C-3)

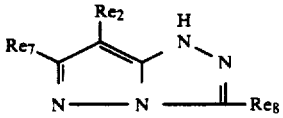

(C-4)

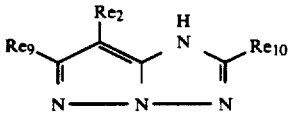

(C-5)

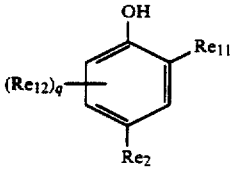

(C-6)

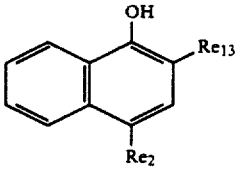

(C-7)

where $Rc_1$ is an aryl group or an alkyl group; $Rc_2$ and $Rc_3$ denote BALL and SOL, respectively, in formula (C-1); $Rc_4$ is a hydrogen atom, a halogen atom, an alkyl group or an alkoxy group; $Rc_5$ is the same as SOL; $Rc_6$ is a hydrogen atom, a halogen atom, an alkyl group, an alkoxy group or an amino group; either one of $Rc_7$ and $Rc_8$ is the same as SOL and the other is a hydrogen atom, an alkyl group, an alkoxy group, an aryl group or an amino group; $Rc_9$ and $Rc_{10}$ have the same meanings as $Rc_7$ and $Rc_8$, respectively; at least one of $Rc_{11}$ and $Rc_{12}$ is the same as SOL and the other is a hydrogen atom, a halogen atom, an alkyl group, an alkoxy group or an alkylamido group; $Rc_{13}$ is the same as SOL; m and n are each an integer that satisfies $m+n\leqq5$ ($m\neq0$ and $n\neq0$), provided that if each of m and n is 2 or more, each of $Rc_3$ and $Rc_4$ are the same or different; p is an integer that satisfies $p\leqq5$ ($p\neq0$), provided that when p is 2 or more, $Rc_6$ may be the same or different; and q is an integer that satisfies $q\leqq3$ ($q\neq0$), provided that when q is 2 or more, $Rc_{12}$ may be the same or different.

8. The method of claim 1 wherein the compound represented by formula (C-9) is a compound specifically represented by either one of the following general formulas (C-10) to (C-13):

(C-10)

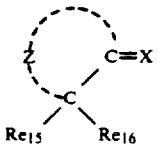

(C-11)

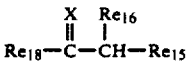

(C-12)

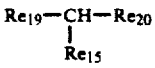

(C-13)

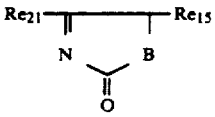

where $Rc_{15}$ has the same meaning has $Rc_{15}$ in formula (C-9); $Rc_{16}$ is a hydrogen atom, a halogen atom, an alkyl group, an aryl group, an alkoxy group, an acyloxy group or a heterocyclic group; X is an oxygen atom or =N—$Rc_{17}$ (where ($Rc_{17}$ is an alkyl group, an aryl group, a hydroxyl group, an alkoxy group or a sulfonyl group); Z represents the group of non-metallic atoms necessary for forming a 5- to 7-membered carbon ring or heterocyclic ring; $Rc_{18}$ is an alkyl group, an aryl group, a heterocyclic group, a cyano group, a hydroxyl group, an alkoxy group, an aryloxy group, a heterocyclic oxy group, an alkylamino group, a dialkylamino group or an anilino group; $Rc_{19}$ and $Rc_{20}$ each represents an alkoxycarbonyl group, a carbamoyl group, an acyl group, a cyano group, a formyl group, a sulfonyl group, a sulfinyl group, a sulfamoyl group, an ammonium group or

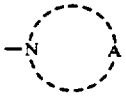

(where A signifies the group of non-metallic atoms necessary for forming a 5- to 7-membered heterocyclic ring together with the nitrogen atom); $Rc_{21}$ is an alkyl group, an aryl group, an anilino group, an alkylamino group or an alkoxy group; and B is an oxygen atom, a sulfur atom or an imino group.

9. The method of claim 1 wherein said compound that reacts with the oxidized product of a color developing agent and which substantially lacks the ability to impart an image density is incorporated in at least one of said silver halide emulsion layer.

10. The method of claim 8 wherein said compound that reacts with the oxidized product of a color developing agent and which substantially lacks the ability to impart an image density is incorporated in at least one of said silver halide emulsion layers in an amount in the range of $1\times10^{-6}$ to $1\times10^{-1}$ mole per square meter.

11. The method of claim 9 wherein said compound that reacts with the oxidized product of a color developing agent and which substantially lacks the ability to impart an image density is incorporated in at least one of said silver halide emulsion layers in an amount in the range of $1\times10^{-5}$ to $2\times10^{-3}$ moles per square meter.

* * * * *